US007453431B2

(12) United States Patent
Ryuh

(10) Patent No.: US 7,453,431 B2
(45) **Date of Patent: *Nov. 18, 2008**

(54) LIQUID CRYSTAL DISPLAY DEVICE AND DRIVING METHOD THEREOF

(75) Inventor: Kentaroh Ryuh, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 395 days.

This patent is subject to a terminal disclaimer.

(21) Appl. No.: 11/324,271

(22) Filed: Jan. 4, 2006

(65) Prior Publication Data

US 2006/0164362 A1 Jul. 27, 2006

Related U.S. Application Data

(63) Continuation of application No. 10/445,806, filed on May 28, 2003, now Pat. No. 7,081,876.

(30) Foreign Application Priority Data

Jul. 1, 2002 (JP) ..... 2002-192685
Mar. 20, 2003 (JP) ..... 2003-077298

(51) Int. Cl.
*G09G 3/36* (2006.01)

(52) U.S. Cl. ..... 345/96; 345/95; 345/100

(58) Field of Classification Search ..... 345/55–100, 345/204–214

See application file for complete search history.

(56) References Cited

U.S. PATENT DOCUMENTS 5,844,537 A * 12/1998 Bonnett et al. ..... 345/97
6,320,562 B1 11/2001 Ueno et al.
6,515,646 B2 2/2003 Tokonami et al.
6,633,272 B1 10/2003 Kumagawa et al.
6,784,863 B2 * 8/2004 Yanagi et al. ..... 345/96
6,961,041 B2 * 11/2005 Ilda et al. ..... 345/90
2002/0158860 A1 * 10/2002 Yang ..... 345/209
2002/0190942 A1 12/2002 Lee

FOREIGN PATENT DOCUMENTS

JP 11-133424 5/1999

* cited by examiner

*Primary Examiner*—David L Lewis
(74) *Attorney, Agent, or Firm*—Harness, Dickey & Pierce, P.L.C.

(57) ABSTRACT

A TFT panel includes (i) a plurality of signal electrodes, (ii) a plurality of scanning electrodes which cross the plurality of signal electrodes, (iii) an active element provided in a vicinity of each intersection at which one of the plurality of signal electrodes and one of the plurality of scanning electrodes cross and connected to the one of the plurality of signal electrodes and the one of the plurality of scanning electrodes, (iv) a pixel electrode driven by the active element, and (v) a counter electrode to which an AC signal is applied, and which faces the pixel electrode. The REVC signal generating circuit generates a counter electrode generating signal, which is to be generated into a counter electrode driving signal by a counter electrode signal generating circuit, in synchronism with a horizontal synchronizing signal in such a manner that the polarity is inverted every horizontal period, and, when one polarity has a length of periods longer than the other polarity during one vertical period, the both polarities of the counter electrode have the same root-mean-square value of voltage during one vertical period by inverting the polarity having the longer period at any timing. With this, it is possible to reduce a low-frequency sound caused by piezoelectricity of a liquid crystal capacitance.

13 Claims, 9 Drawing Sheets

LIQUID CRYSTAL DISPLAY DEVICE AND DRIVING METHOD THEREOF

RELATED APPLICATIONS

This is a continuation of, and claims priority under 35 U.S.C. § 120 on, U.S. application Ser. No. 10/445,806, filed May 28, 2003, now U.S. Pat. No. 7,081,876 which further claims priority under 35 U.S.C. § 119 to Japanese Patent Application Nos. 2002-192685 filed Jul. 1, 2002 and 2003-077298 filed Mar. 20, 2003, the entire contents of all of which are hereby incorporated herein by reference.

FIELD OF THE INVENTION

The present invention relates to a driving method of a liquid crystal display device; and in particular to a liquid crystal display device capable of reducing a low-frequency sound caused by piezoelectricity of a liquid crystal capacitance and a driving method thereof.

BACKGROUND OF THE INVENTION

In a conventional liquid crystal display device that drives matrix electrodes using line inversion, a counter electrode driving signal is controlled to be inverted every horizontal period and every vertical period. Further, the counter electrode driving signal may be fixed at "Lo" during a retrace period in order to reduce differences in luminance among gate lines and to improve display quality; and the polarity of the counter electrode driving signal may be adjusted in order to prevent flicker and image burn on the panel, etc.

Here, in the liquid crystal display device driven using line inversion, the counter electrode driving signal is inverted every horizontal period and every vertical period. Thus, where a vertical period consists of n (n is an odd number) horizontal periods, a period in which the counter electrode driving signal is "Hi" (or "Lo") may be generated longer than the other period during one vertical period.

In this case, a liquid crystal panel serves as a condenser, and thus amplitude of the counter electrode driving signal causes piezoelectricity. This accordingly generates low-frequency vibration, and makes a sound from a panel surface (hereinafter, the sound is referred to as a "low-frequency sound").

FIG. 7 is a block diagram schematically showing an arrangement of a liquid crystal display device 101 in accordance with a conventional technique.

In the liquid crystal display device 101, a control IC 103 generates a gate driver driving signal GDD, a source driver driving signal SDD, and a counter electrode generating signal REVC in response to a horizontal synchronizing signal HSY, a vertical synchronizing signal VSY, a data clock input signal DCK, and an image data input signal RGB. Then, the gate driver driving signal GDD is supplied to a gate driver 112, and the source driver driving signal SDD is supplied to a source driver 113. Further, a counter electrode signal generating circuit 104 generates a counter electrode driving signal OED in response to the counter electrode generating signal REVC supplied from the control IC 103, and then supplies the counter electrode driving signal OED to a counter electrode (not shown) of a TFT panel 111.

Next, with reference to FIGS. 8 and 9, a general input signal for progressive display will be explained. FIGS. 8 and 9 show the vertical synchronizing signal VSY, the horizontal synchronizing signal HSY, the counter electrode generating signal REVC, and a period for displaying a first line of video data, in the liquid crystal display device 101. The counter electrode generating signal REVC is inverted in synchronism with the horizontal synchronizing signal HSY.

FIG. 8 shows a case where one vertical period consists of an even number of horizontal periods. As shown in FIG. 8, the control IC 103 controls the counter electrode generating signal REVC to be "Hi" when a first vertical synchronizing signal VSY is supplied, and to be "Lo" when a second vertical synchronizing signal VSY is supplied. In this case, the "Hi" period and the "Lo" period of the counter electrode generating signal REVC have the same length during one vertical period. As a result, the low-frequency sound from the surface of the TFT panel 111 is not audible.

FIG. 9 shows a case where one vertical period consists of an odd number of horizontal periods. As shown in FIG. 9, the control IC 103 controls the counter electrode generating signal REVC to be "Hi" when a first vertical synchronizing signal VSY is supplied, and to be "Lo" when a second vertical synchronizing signal VSY is supplied. In this case, however, one of the "Hi" and "Lo" periods of the counter electrode generating signal REVC becomes longer than the other during one vertical period. As a result, the low-frequency sound from the surface of the TFT panel 111 is audible.

Conventionally, to address this low-frequency sound, by inserting a tantalum condenser between the counter electrode driving signal and a ground terminal, the low-frequency sound is converted into an unnoticeable sound, thereby reducing the "sounding" on the panel surface. Further, by covering the liquid crystal display device with a housing to cover the panel surface, the "sounding" is reduced.

Further, Japanese Unexamined Patent Publication No. 133424/1999 (Tokukaihei 11-133424; published on May 21, 1999; hereinafter referred to as "Patent Publication 1") discloses a liquid crystal display device, which aims to reduce the sounding of an EL light-emitting element used as a backlight, and to reduce the thickness of the liquid crystal display device. In this liquid crystal display device, a daubed copper foil pattern is formed on a surface that faces the EL light-emitting element on a printed substrate, and the copper foil pattern is electrically connected with a front electrode so as to apply a common mode AC voltage.

However, the conventional method to insert the tantalum condenser between the counter electrode driving signal and the ground terminal or to cover the panel surface with the housing has the following problems. For example, this brings about an unnecessary cost, and, since this does not remove the fundamental cause of the low-frequency sound, the low-frequency sound occurs again when an operating frequency is varied in the liquid crystal display device. Further, the Patent Publication 1 does not describe a method to reduce the sounding from a viewpoint of circuitry.

SUMMARY OF THE INVENTION

An object of the present invention is to provide a liquid crystal display device capable of reducing a low-frequency sound caused by piezoelectricity of a liquid crystal capacitance, and a driving method thereof.

In order to attain the foregoing object, a method for driving a liquid crystal display device of the present invention which includes (i) a plurality of signal electrodes, (ii) a plurality of scanning electrodes which cross the plurality of signal electrodes, (iii) an active element provided in a vicinity of each intersection at which one of the plurality of signal electrodes and one of the plurality of scanning electrodes cross and connected to the one of the plurality of signal electrodes and the one of the plurality of scanning electrodes, (iv) a pixel electrode driven by the active element, and (v) a counter electrode to which an AC signal is applied, and which faces the pixel electrode, is arranged so as to have the step of generating a counter electrode driving signal, which drives the counter electrode, in such a manner that, when a root-mean-square value of voltage in a period of one polarity is different from a root-mean-square value of voltage in a period of the other polarity, the root-mean-square value of voltage in the period of one polarity becomes equal to the root-mean-square value of voltage in the period of the other polarity during one vertical period.

Generally, in the video display period, the counter electrode driving signal is inverted every horizontal period. On the other hand, in the vertical retrace period, the counter electrode driving signal may be inverted at any timing.

With the above-described method, the both polarities ("Hi (+ polarity)" and "Lo (– polarity)") of the counter electrode driving signal have the same root-mean-square value of voltage during one vertical period, thereby reducing the low-frequency sound caused by the piezoelectricity of a liquid crystal capacitance. Further, the timing to invert the polarity of the counter electrode driving signal can be varied while reducing the low-frequency sound. Namely, it is possible to reduce the low-frequency sound caused by the piezoelectricity of a liquid crystal capacitance, even when the interval for inverting the polarity varies.

Therefore, with the above-described method for driving the liquid crystal display device, it is possible to realize a liquid crystal display device that can prevent the low-frequency sound from the panel surface and thus does not disturb quiet surroundings, even when the counter electrode driving signal is inverted every horizontal period, for example, during one vertical period to prevent image burn on the panel. This liquid crystal display device is preferably used as a liquid crystal display device which is, recently in many cases, used in a quiet place such as an office, for example.

Note that, generally, in a liquid crystal display device using a line driving method, a potential difference between the counter electrode and a gradation power supply voltage determines a gradation value to be displayed. Namely, when the counter electrode generating signal is inverted at a timing during the display period in a liquid crystal display device using a line inversion driving method, a problem occurs such that display color turns. Thus, when inverting the counter electrode generating signal REVC as described above, it is easier in terms of circuit design to invert the counter electrode generating signal only during the vertical retrace period where liquid crystal display is not shown. However, by adding a circuit to prevent the problem in liquid crystal display occurs when inverting the counter electrode generating signal during the display period, it becomes possible to invert the counter electrode generating signal at any timing during one vertical period including the display period.

Further, a liquid crystal display device of the present invention is arranged so as to include a counter electrode signal generating circuit and a counter electrode generating signal (REVC signal) output circuit for generating a counter electrode driving signal using the above-described method for driving the liquid crystal display device.

With this arrangement, one polarity of the counter electrode driving signal does not become longer than the other polarity, thereby reducing the low-frequency sound caused by the piezoelectricity of a liquid crystal capacitance. Therefore, it is possible to realize a liquid crystal display device that can prevent the low-frequency sound from the panel surface and thus does not disturb quiet surroundings. This liquid crystal display device is preferably used as a liquid crystal display device which is, recently in many cases, used in a quiet place such as an office, for example.

For a fuller understanding of the nature and advantages of the invention, reference should be made to the ensuing detailed description taken in conjunction with the accompanying drawings.

DESCRIPTION OF THE EMBODIMENTS

The following will explain an embodiment of the present invention with reference to FIGS. 1 through 6. Note that, the present embodiment will explain an example in which a matrix liquid crystal display device uses a TFT (thin film transistor) as an active element, but the present invention can be applied to a liquid crystal display device using any active element (two-terminal element, for example).

Figure 1:
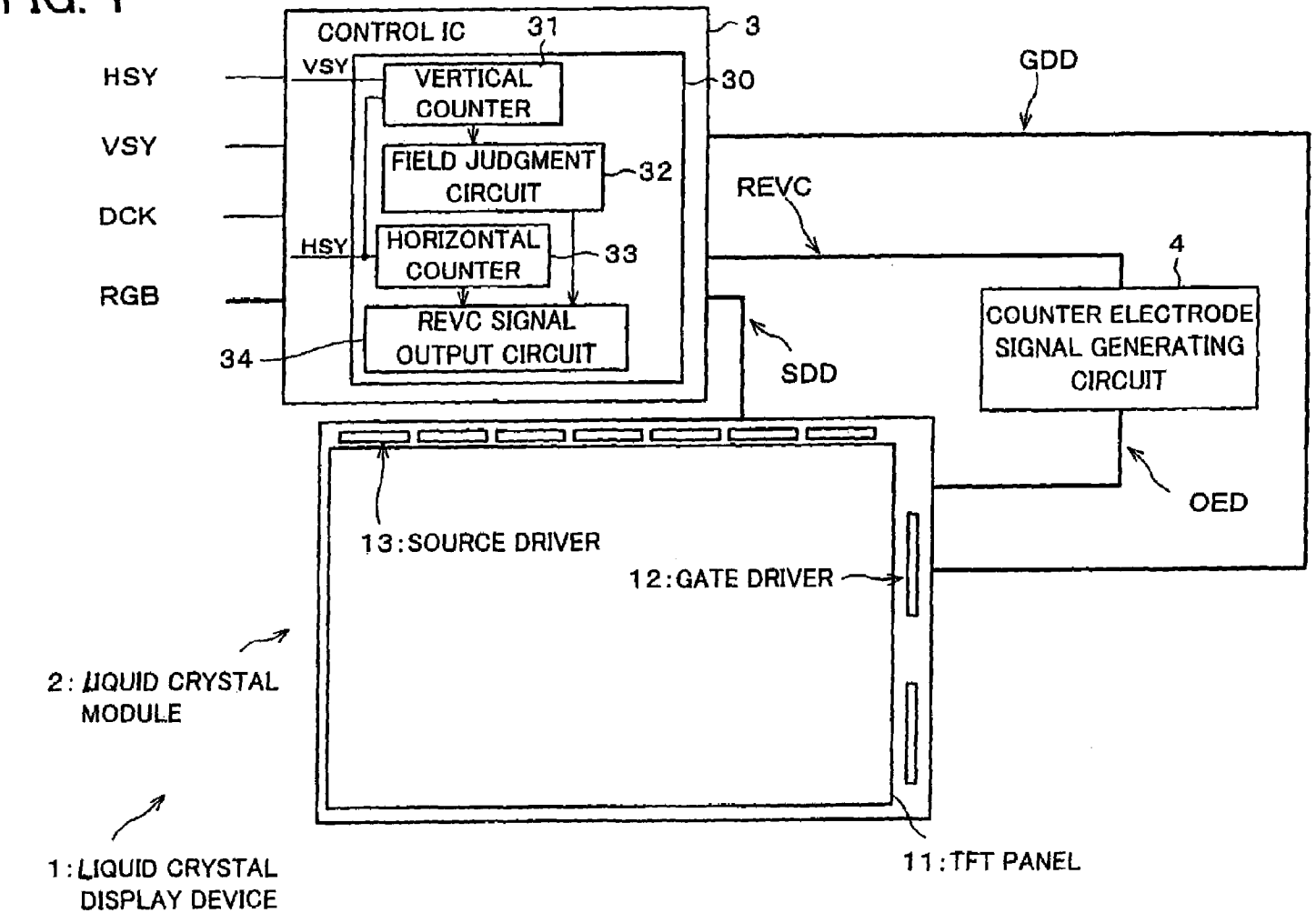
FIG. 1 is a block diagram schematically showing an arrangement of a liquid crystal display device in accordance with an embodiment of the present invention.

FIG. 1 is a block diagram schematically showing an arrangement of a liquid crystal display device 1 in accordance with the present embodiment. As shown in FIG. 1, the liquid crystal display device 1 is composed of a liquid crystal module 2 in which a gate driver 12 and a source driver 13 are provided on a TFT panel 11; and peripheral circuits including a control IC (integrated circuit) 3 and a counter electrode signal generating circuit 4.

The TFT panel 11 has an ordinary panel structure. Specifically, the TFT panel 11 is provided with a plurality of signal electrodes that run parallel to one another; a plurality of scanning electrodes which cross the signal electrodes; a TFT provided in a vicinity of each intersection at which one of the plurality of signal electrodes and one of the plurality of scanning electrodes cross and connected to the one of the plurality of signal electrodes and the one of the plurality of scanning electrodes; a pixel electrode driven by the TFT; and a counter electrode to which an AC signal is applied, and which faces the pixel electrode.

A gate driver 12 is connected to the scanning electrodes on the TFT panel 11, and a source driver 13 is connected to the signal electrodes on the TFT panel 11. Further, the source driver 13 is a digital source driver for line inversion driving.

A control IC 3 is an IC for generating liquid crystal driving signals (gate driver driving signal GDD, source driver diving signal SDD, and counter electrode generating signal REVC) in response to input signals (horizontal synchronizing signal HSY, vertical synchronizing signal VSY, data clock input signal DCK, and image data input signal RGB).

The control IC 3 supplies the gate driver driving signal GDD to the gate driver 12 on the TFT panel 11, and supplies the source driver driving signal SDD to the source driver 13 on the TFT panel 11. Further, the control IC 3 supplies the counter electrode generating signal REVC to the counter electrode signal generating circuit 4.

The counter electrode signal generating circuit (counter electrode driving signal generating means) 4 generates a counter electrode driving signal OED by amplifying the counter electrode generating signal REVC received from the control IC 3, and supplies the counter electrode driving signal OED to a counter electrode (not shown) of the TFT panel 11. Note that, in the present embodiment, the counter electrode signal generating circuit 4 generates the counter electrode driving signal OED by amplifying the counter electrode generating signal REVC to have a peak-to-peak value of about 7 $V_{p\text{-}p}$.

Here, the horizontal synchronizing signal HSY is a horizontal synchronizing signal including a horizontal enable signal. The vertical synchronizing signal VSY is a vertical synchronizing signal including a vertical enable signal. The data clock input signal DCK is a clock signal including an RGB input data shift clock signal and a horizontal counter operating input clock signal. The image data input signal RGB is a digital input signal of video data (8 bit×3, 6 bit×3, etc.).

Further, the gate driver driving signal GDD is a signal for driving the gate driver 12, including a start pulse signal, a scanning direction switching signal, a gate shift clock signal, etc. Like the gate driver driving signal GDD, the source driver driving signal SDD is a signal for driving the source driver 13, including a plurality of signals. The counter electrode generating signal REVC is a logic output signal to be generated into the counter electrode driving signal OED that drives the counter electrode of the TFT panel 11. Further, the counter electrode driving signal OED is a signal for driving the counter electrode, generated by amplifying the counter electrode generating signal REVC.

With this arrangement, in the liquid crystal display device 1, by receiving the horizontal synchronizing signal HSY, the vertical synchronizing signal VSY, the data clock input signal DCK, and the image data input signal RGB, the control IC 3 generates the gate driver driving signal GDD, the source driver driving signal SDD, and the counter electrode generating signal REVC. Then, the gate driver driving signal GDD is supplied to the gate driver 12, and the source driver driving signal SDD is supplied to the source driver 13. Further, the counter electrode signal generating circuit 4 generates the counter electrode driving signal OED based on the counter electrode generating signal REVC, and supplies the counter electrode driving signal OED to the counter electrode.

Here, in the liquid crystal display device 1, the control IC 3 is provided with an REVC signal generating circuit 30. The REVC signal generating circuit 30 is a circuit for generating the counter electrode generating signal REVC in response to the horizontal synchronizing signal HSY and the vertical synchronizing signal VSY that are supplied to the control IC 3, and for supplying the counter electrode generating signal REVC to the counter electrode signal generating circuit 4.

Specifically, as shown in FIG. 1, the REVC signal generating circuit is arranged so as to include a vertical counter 31, a field judgment circuit 32, a horizontal counter 33, and an REVC signal output circuit 34.

The vertical counter (counting means) 31 is a counter circuit for detecting and counting a falling edge of the vertical synchronizing signal VSY. The counter is reset when a next vertical synchronizing signal VSY is supplied.

The field judgment circuit (judging means) 32 is a circuit for judging whether the number of horizontal periods during one vertical period is odd or even (whether it is odd field or even field) based on a decoded value of the vertical counter at a time the vertical synchronizing signal VSY is supplied.

The horizontal counter (counting means) 33 is a counter circuit for detecting and counting a falling edge of the horizontal synchronizing signal HSY. The counter is reset when a next horizontal synchronizing signal HSY or a horizontal enable signal is supplied.

The REVC signal output circuit (counter electrode driving signal generating means) 34 is provided with a decoder circuit for inverting the polarity of the counter electrode generating signal REVC at any timing during one horizontal period in synchronism with the horizontal synchronizing signal HSY, based on a decoded value of the horizontal counter. With this, the REVC signal output circuit 34 generates the counter electrode generating signal REVC whose polarity is inverted for a half, one-fourth, or one-eighth horizontal period, for example.

With this arrangement, in the REVC signal generating circuit 30, after the vertical counter 31 is reset upon receipt of the vertical synchronizing signal VSY, the field judgment circuit 32 judges whether the number of horizontal synchronizing signals HSY supplied during one vertical period is odd or even, based on the number of supplied horizontal synchronizing signals HSY that are counted at the falling edges.

Figure 8:
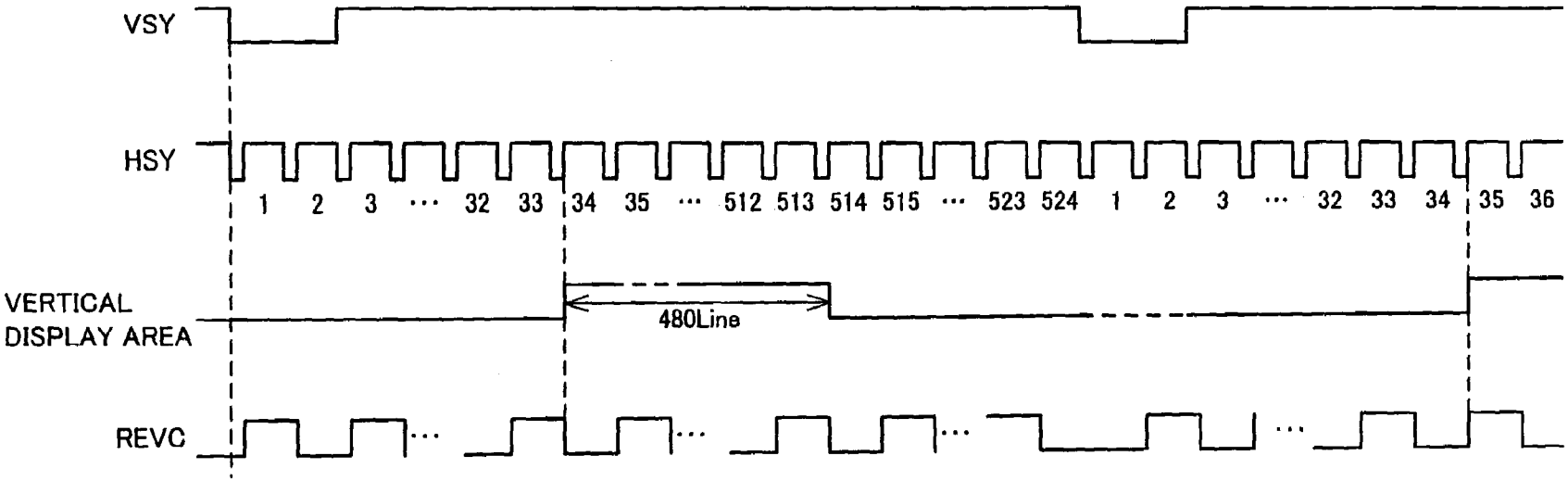
FIG. 8 is a timing chart showing an example of a driving signal of the liquid crystal display device in which one vertical period consists of an even number of horizontal periods.
Figure 9:
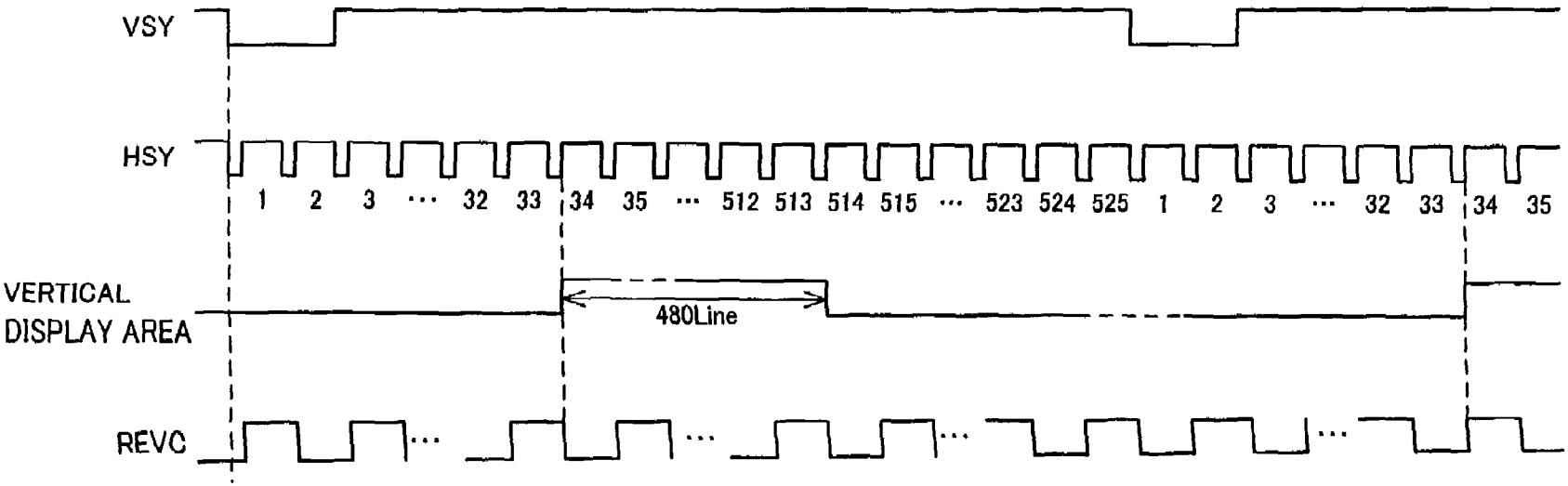
FIG. 9 is a timing chart showing an example of a driving signal of the liquid crystal display device in which one vertical period consists of an odd number of horizontal periods.

A TFT liquid crystal panel is generally arranged to invert the polarity of the counter electrode every horizontal period and every vertical period in order to prevent image burn on the panel due to the application of a DC voltage. Namely, in the TFT panel 11, the voltage applied to the same line on the panel is inverted every horizontal period and every vertical period during a display period (FIGS. 8 and 9).

Figure 2:
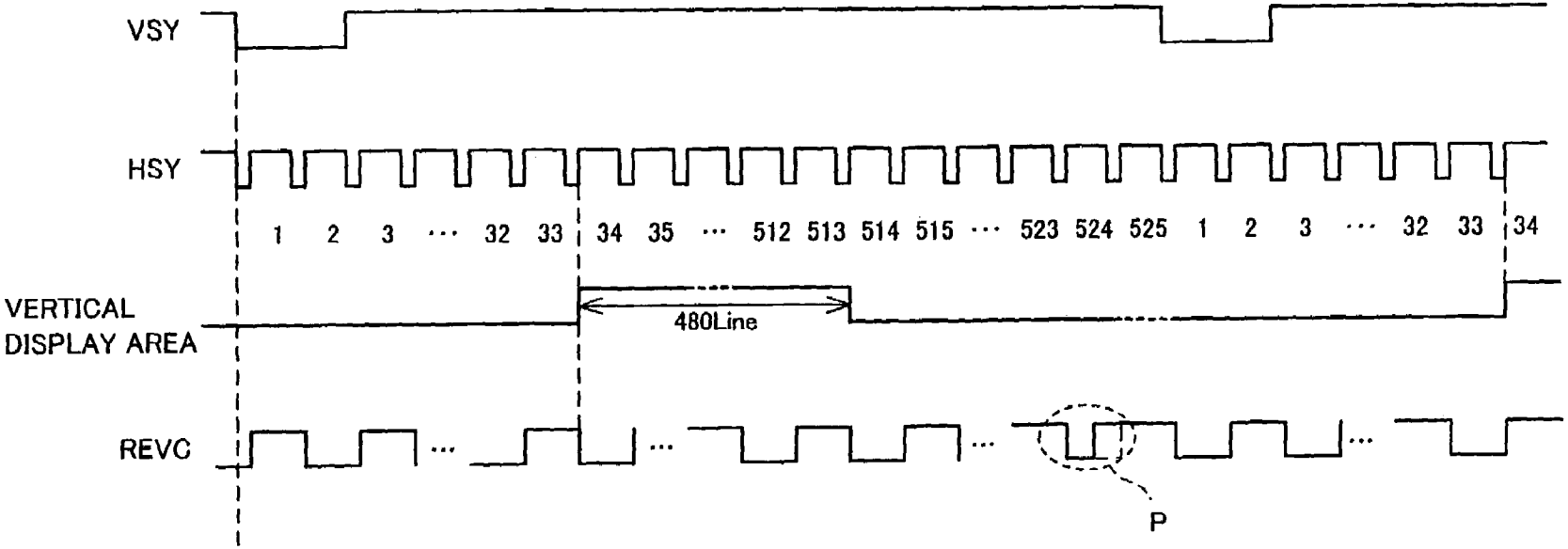
FIG. 2 is an improved example of an REVC signal, which is a driving signal of the liquid crystal display device shown in FIG. 1, in which one vertical period consists of an even number of horizontal periods.
Figure 3:
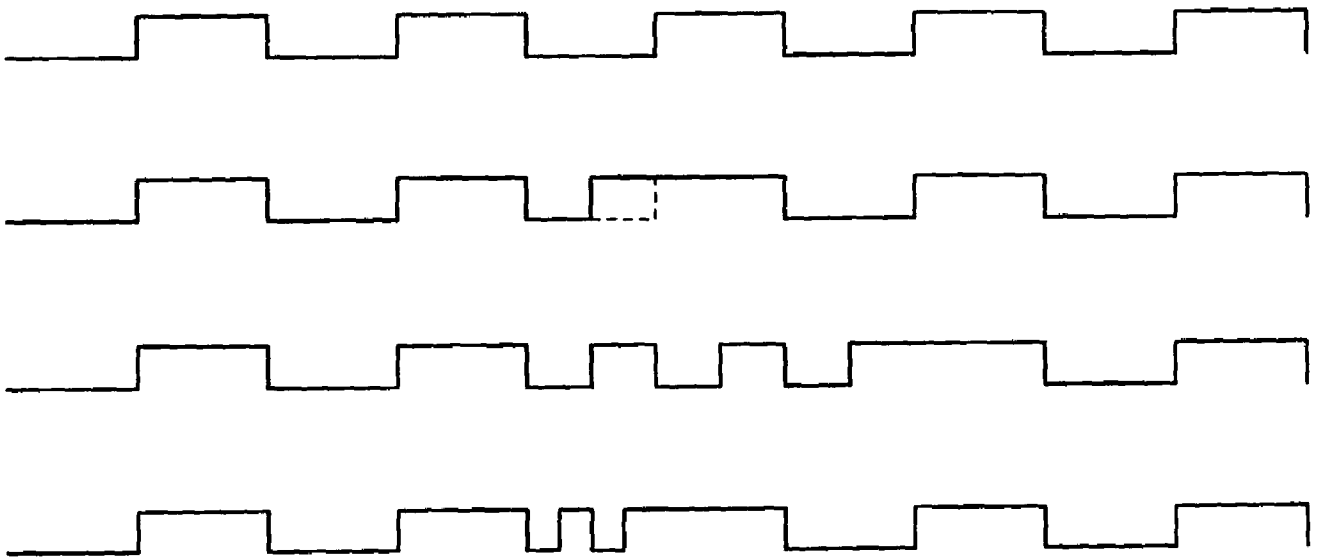
FIGS. 3(*a*) to 3(*d*) show waveform examples of an REVC signal, which is a driving signal of the liquid crystal display device of FIG. 1, in which one vertical period consists of an odd number of horizontal periods.

Accordingly, when an odd number of horizontal synchronizing signals HSY are supplied during one vertical period, one of the "Hi" and "Lo" polarities of the counter electrode generating signal REVC becomes longer than the other for one horizontal period. Thus, the REVC signal output circuit 34 generates and outputs the counter electrode generating signal REVC in such a manner that (A) one pulse of the polarity that is longer for one horizontal period is inverted for a half, one-fourth, or one-eighth horizontal period at any timing during one vertical period, or (B) the counter electrode generating signal REVC is inverted at a timing outside the display period to equalize (the "Hi" voltage×the root-mean-square value of voltage in the "Hi" voltage period) and (the "Lo" voltage×the root-mean-square value of voltage in the "Lo" voltage period) of the counter electrode (FIGS. 2 and 3).

Here, when inverting the polarity every horizontal period, a root-mean-square value component S of the counter electrode driving signal OED during one vertical period is expressed as the following expression (1). Note that, ω is 2π (fh/2), fh is horizontal frequency, fv is vertical frequency, Th is a horizontal period, and Tv is a vertical period.

[EXPRESSION 1]

$$S = \int_0^{1/fv} \sin\omega t dt = -\frac{1}{\omega}[\cos\omega t]_0^{1/fv} = -\frac{1}{\pi fh}\left[\cos\pi fh \times \frac{1}{fv} - 1\right]$$

$$k = \frac{fh}{fv} = \frac{1/Th}{1/Tv} = \frac{Tv}{Th}$$

$$\therefore |S| = \frac{1}{\pi fh}\{\cos k\pi - 1\}$$

When divided by cases whether k is even or odd, the expression (1) is expressed as the following expression (2).

[EXPRESSION 2]

(i) When $k = 2n$ (even number), $\cos k\pi = +1$ $|S| = 0$ … sound is small (does not occur)

(ii) When $k = 2n + 1$ (odd number), $\cos k\pi = -1$ $|S| = \frac{2}{\pi fh}$ … sound occurs Further, as explained in a conventional technique, in the liquid crystal display device 101, the low-frequency sound is not audible when the polarity of the counter electrode driving signal OED is inverted in an even number of times during one vertical period (FIG. 8); while the low-frequency sound is audible when the polarity of the counter electrode driving signal OED is inverted in an odd number of times during one vertical period (FIG. 9). For example, when an NTSC signal is used for progressive driving, the signal may be generated so that one vertical period consists of 525 horizontal periods, or one vertical period consists of 400 horizontal periods in cases such that digital video data is simply displayed. When the counter electrode driving signal OED is arranged so that one vertical period is an even multiple of one horizontal period, the low-frequency sound is not audible.

These facts suggest that the low-frequency sound occurs on the liquid crystal panel when the root-mean-square value component S exists. In other words, the polarity inversion of the counter electrode driving signal OED presumably causes the low-frequency sound. Namely, it is possible to reduce the low-frequency sound by supplying the counter electrode generating signal REVC that cancels the root-mean-square value component S.

As described above, the low-frequency sound occurs on the liquid crystal panel because one polarity of the counter electrode generating signal REVC is longer than the other polarity for one horizontal period when one vertical period consists of an odd number of horizontal periods. Thus, even when an odd number of horizontal synchronizing signals HSY are supplied during one vertical period, the liquid crystal display device 1 generates the counter electrode driving signal OED (namely, counter electrode generating signal REVC) so as not to allow one polarity of the counter electrode driving signal OED to be longer than the other polarity for one horizontal period. As a result, the low-frequency sound does not occur even when the polarity of the counter electrode driving signal OED is inverted in an odd number of times, as well as in an even number of times, during one vertical period.

Thus, in the liquid crystal display device 1, as shown in FIG. 8, when an even number of horizontal synchronizing signals HSY are supplied during one vertical period, the polarity of the counter electrode generating signal REVC is inverted every vertical period. On the other hand, as shown in FIG. 9, when an odd number of horizontal synchronizing signals HSY are supplied during one vertical period, the polarity of the counter electrode generating signal REVC is inverted every vertical period, and one pulse of a polarity that is longer for one horizontal period is inverted for a half horizontal period at any timing during one vertical period, as shown in FIG. 2.

FIG. 2 is an example of the generated counter electrode generating signal REVC where one vertical period consists of an odd number of horizontal periods. As shown in FIG. 2, the REVC signal output circuit 34 adjusts a half of one "Lo" period to be a "Hi" period (the "p" portion in FIG. 2) during a vertical retrace period after a video display period (a period of 480 Line) within one vertical period.

Here, as shown in FIGS. 3(*a*) to 3(*d*), when one vertical period consists of an odd number of horizontal periods and the "Hi" voltage and the "Lo" voltage of the counter electrode generating signal REVC are fixed, various settings are possible for the timing to adjust the counter electrode generating signal REVC to have the equal length of "Lo" and "Hi" periods during one vertical period.

Specifically, FIG. 3(*a*) is a waveform of the counter electrode generating signal REVC that is not adjusted. On the other hand, as shown in FIG. 3(*b*), the polarity of the counter electrode generating signal REVC may be inverted for a half horizontal period at a half point of the horizontal period during the vertical retrace period. Further, as shown in FIG. 3(*c*), the polarity of the counter electrode generating signal REVC may be inverted in a plurality of times at the timing shown in FIG. 3(*b*) during the vertical retrace period. Further, as shown in FIG. 3(*d*), the "Hi" period added for adjustment (FIG. 3(*b*)) may be divided into a plurality of pulses each having a one-fourth or one-eighth horizontal period.

Generally, in a liquid crystal display device using a line driving method, a potential difference between the counter electrode and a gradation power supply voltage determines a gradation value to be displayed. Namely, when the counter electrode generating signal REVC is inverted at a timing during the display period in a liquid crystal display device using a line inversion driving method, a problem occurs such that display color turns. Thus, when inverting the counter electrode generating signal REVC in a plurality of times during one horizontal period as described above, it is easier in terms of circuit design to invert the counter electrode generating signal REVC only during the vertical retrace period where liquid crystal display is not shown. However, by adding a circuit to prevent the problem in liquid crystal display that occurs when inverting the counter electrode generating signal REVC during the display period, it becomes possible to invert the counter electrode generating signal REVC at any timing during one vertical period including the display period.

Here, with reference to FIGS. 4 through 6, the effects of reducing the low-frequency sound in the liquid crystal display device 1 will be explained using concrete examples. Note that, each of the "a," "b," and "c" portions in FIGS. 4 through 6 indicates a waveform of frequency spectrum of a counter substrate.

Figure 4:
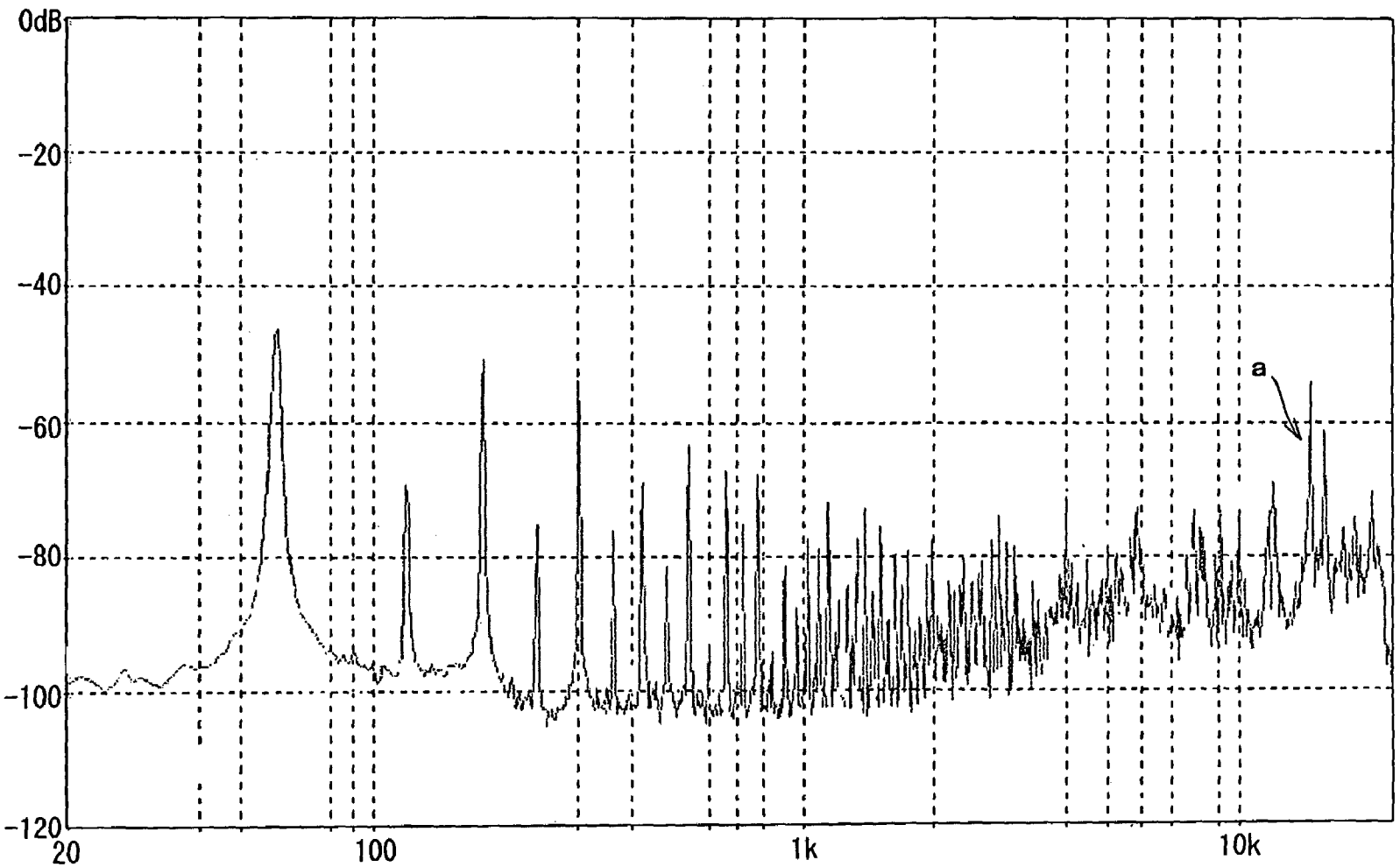
FIG. 4 is a spectrum waveform chart showing a level of a low-frequency sound in the liquid crystal display device shown in FIG. 1, when an REVC signal generating circuit is not operated.

FIG. 4 shows the waveform where the REVC signal generating circuit 30 is not operated, namely where input signals (HSY, VSY, DCK, etc.) and electric power are not supplied to the control substrate and the TFT panel 11 is not operated. The "a" portion in FIG. 4 indicates the loudness of the sound, which is approximately −54 db, at a cycle (reciprocal number of frequency) where the counter electrode driving signal OED is inverted.

Figure 5:
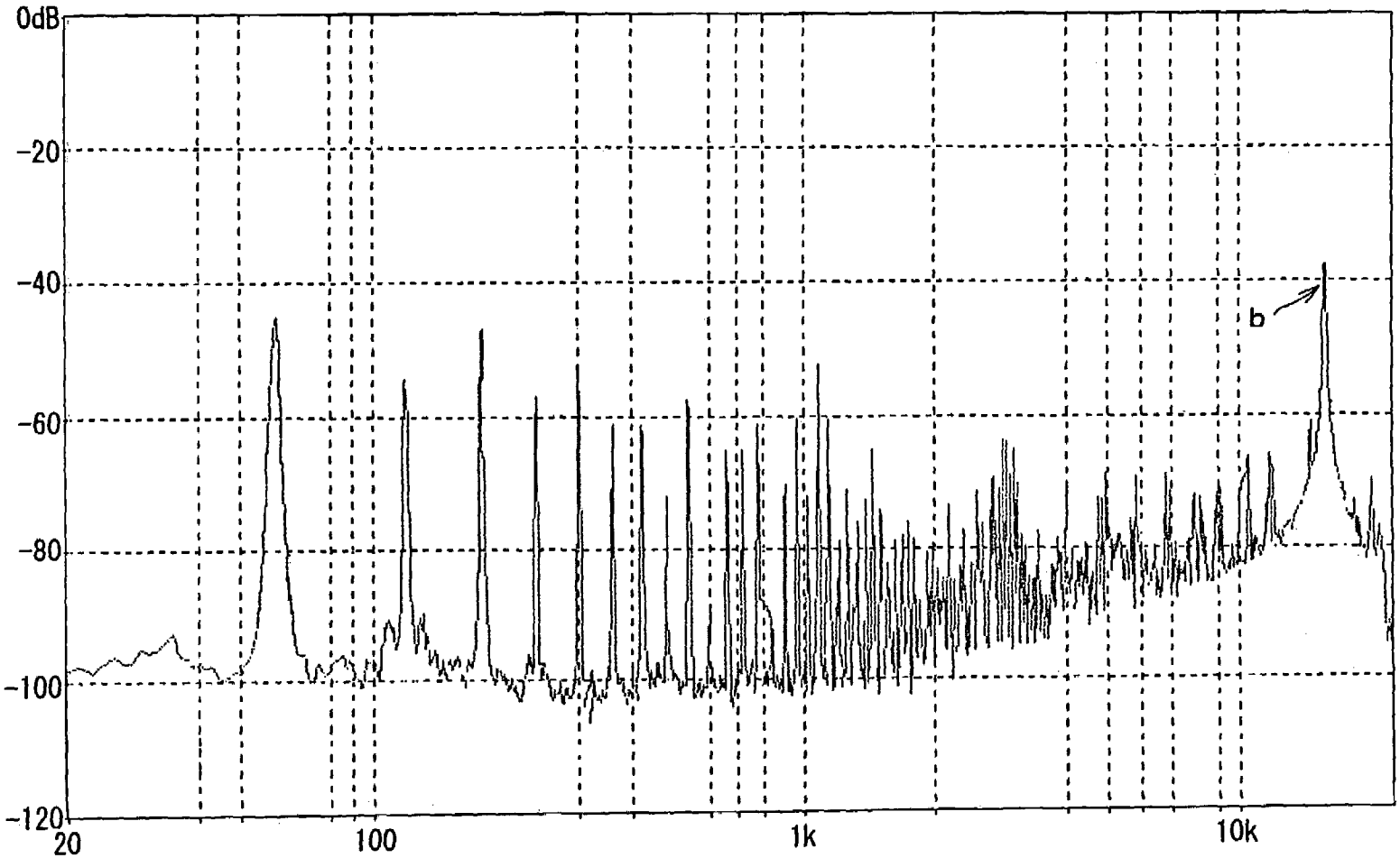
FIG. 5 is a spectrum waveform chart showing a level of a low-frequency sound in the liquid crystal display device shown in FIG. 1, when the REVC signal generating circuit is operated (one vertical period consists of 524 horizontal periods).

FIG. 5 shows a waveform indicating a level of the low-frequency sound when the TFT panel 11 is operated so that one vertical period consists of 524 horizontal periods (one vertical period consists of an even number of horizontal periods). The "b" portion in FIG. 5 indicates the loudness of the sound, which is approximately −38 db, at a cycle where the counter electrode driving signal OED is inverted.

Figure 6:
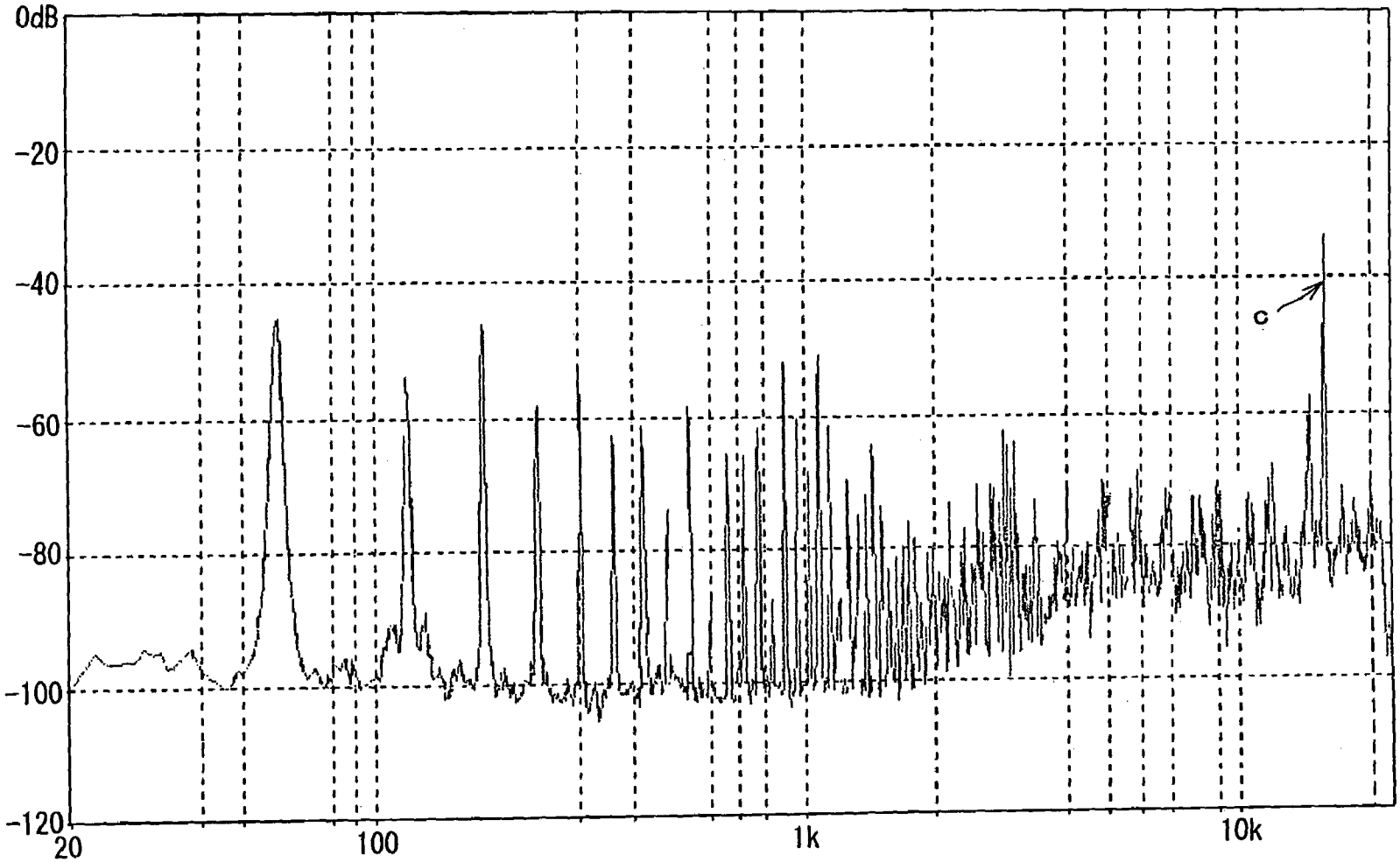
FIG. 6 is a spectrum waveform chart showing a level of a low-frequency sound in the liquid crystal display device shown in FIG. 1, when the REVC signal generating circuit is operated (one vertical period consists of 525 horizontal periods).
Figure 7:
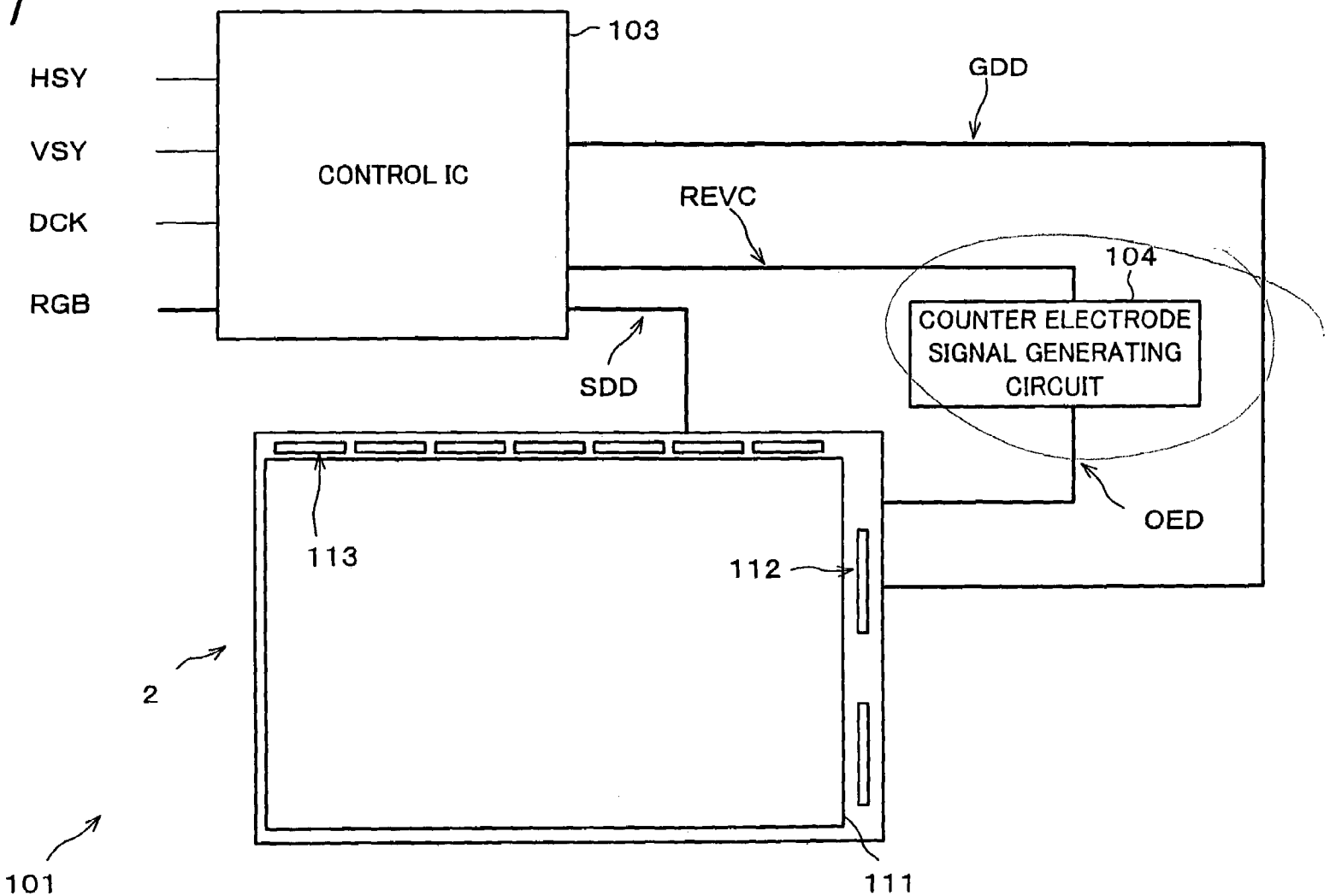
FIG. 7 is a block diagram schematically showing an arrangement of a liquid crystal display device in accordance with a conventional technique.

FIG. 6 shows a waveform indicating a level of the low-frequency sound when the TFT panel 11 is operated so that one vertical period consists of 525 horizontal periods (one vertical period consists of an odd number of horizontal periods). The "c" portion in FIG. 6 indicates the loudness of the sound, which is approximately −32 db, at a cycle where the counter electrode driving signal OED is inverted.

As described above, the "a," "b," and "c" portions in FIGS. 4 through 6 have the frequency of about 15 kHz, and these portions coincide with the timing when the counter electrode generating signal REVC is inverted. This reveals that the sound is smaller when one vertical period consists of an even number of horizontal periods.

As described above, in the liquid crystal display device 1, the REVC signal output signal 34 generates the counter electrode generating signal REVC so as to supply the counter electrode with the counter electrode driving signal OED that is inverted every horizontal period during one vertical period or inverted at any timing during one vertical retrace period. With this, it is possible to invert the counter electrode driving signal OED in an even number of times during one vertical period.

Further, in the liquid crystal display device 1, when the counter electrode driving signal OED is inverted in an odd number of times during one vertical period, the REVC signal output circuit 34 inverts the counter electrode driving signal OED for a half horizontal period at any timing during one vertical period. This allows both the + and − polarities of the counter electrode driving signal OED to have the same root-mean-square value of voltage. Thus, in either case where one vertical period consists of an even or odd multiple of one horizontal period, the liquid crystal panel serves as a condenser, thereby reducing the sounding phenomenon due to the low-frequency vibration caused by piezoelectricity. In other words, it is possible to reduce the low-frequency sound caused by the piezoelectricity of a liquid crystal capacitance due to the amplitude of the counter electrode signal.

Note that, the present embodiment does not limit the scope of the present invention. The same may be varied in many ways within the scope of the present invention, and may be arranged as follows, for example.

The liquid crystal display device 1 may be arranged so as to generate the counter electrode driving signal OED in which one vertical period consists of an even number of horizontal periods, when the counter electrode driving signal OED is inverted every horizontal period during one vertical period.

Generally, the low-frequency sound that occurs from the surface of the TFT panel 11 is smaller when one vertical period consists of an even number of horizontal periods compared with a case where one vertical period consists of an odd number of horizontal periods. Thus, the liquid crystal display device 1 generates the counter electrode driving signal OED in which one vertical period consists of an even number of horizontal periods.

With this, one polarity of the counter electrode driving signal OED does not have a period longer than the other polarity for one horizontal period, thereby preventing the low-frequency sound.

Further, the liquid crystal display device 1 may be arranged so as to output the counter electrode driving signal OED having the same number of the "Hi" periods and the "Lo" periods, when the counter electrode driving signal OED is inverted every any predetermined period in a plurality of times during one vertical period.

The polarity of the counter electrode driving signal OED is inverted to prevent image burn on the panel. Thus, the counter electrode driving signal OED may be inverted only during the video display period, but, when generating the counter electrode driving signal OED, it is easier to control the counter electrode driving signal OED to be inverted every horizontal period during one vertical period including the vertical retrace period. However, one vertical period may be an even or odd multiple of one horizontal period. Thus, when inverting the counter electrode driving signal OED every horizontal period, the liquid crystal display device 1 generates the counter electrode driving signal OED so that one vertical period consists of an even number of horizontal periods.

With this, it is possible to invert the counter electrode driving signal OED every predetermined period (one horizontal period, etc.), and it is possible to invert the counter electrode driving signal OED every vertical period so that the "Hi" periods (+ polarity) and the "Lo" periods (− polarity) have the same number, thereby reducing the low-frequency sound.

Further, the liquid crystal display device 1 may be arranged so as to generate the counter electrode driving signal OED in such a manner that the polarity in one horizontal period is inverted in a next horizontal period every time, the root-mean-square value of voltage in the "Hi" period of the counter electrode becomes equal to the root-mean-square value of voltage in the "Lo" period during one vertical period.

In the video display period, the counter electrode driving signal OED is inverted every horizontal period. On the other hand, in the retrace period, the counter electrode driving signal OED may be inverted at any timing. Thus, even when a length of inversion timing varies during one vertical period, the counter electrode driving signal OED in the vertical retrace period is inverted every time so as to have the same length of the "Hi" periods and the "Lo" periods.

With this, when the counter electrode driving signal OED is divided by any length during one vertical period; for example, when a period length (one pulse width) of the counter electrode driving signal OED is different in the vertical display period and in the vertical retrace period, the counter electrode driving signal OED may be generated so that the pulse signal is inverted to have the equal "Hi" and "Lo" periods in each of the vertical display and retrace periods, thereby reducing the low-frequency sound.

Namely, in the video display period (a period of 480 Line in FIG. 2), the counter electrode generating signal REVC needs to be inverted every vertical period and every horizontal period, but there is no such constraint in the vertical retrace period. Accordingly, in the vertical retrace period, there is no need to generate the counter electrode generating signal REVC in synchronism with the horizontal synchronizing signal HSY, so that the counter electrode generating signal REVC can be inverted at any timing. Therefore, an inversion timing of the counter electrode generating signal REVC can be determined so that the both polarities have the same root-mean-square value of voltage during one vertical period.

Further, the liquid crystal display device 1 may be so arranged that, when one of the "Hi" period and the "Lo" period is longer than the other, the polarity having the longer period is inverted for a half of a surplus period of the longer period.

When the counter electrode driving signal OED is inverted every horizontal period, one of the "Hi" period and the "Lo" period may become longer than the other in a case where one vertical period consists of an odd number of horizontal periods. Likewise, when the counter electrode driving signal OED is generated at any timing during the vertical retrace period, one of the "Hi" period and the "Lo" period may become longer than the other during one vertical period. In these cases, by inverting the counter electrode driving signal OED for a half of the surplus period, the "Hi" periods in total and the "Lo" periods in total can have the same length during the vertical period.

With this, even when one vertical period consists of an odd number of horizontal periods and one of the + and − polarities of the counter electrode driving signal OED is longer than the other polarity for one horizontal period, by inverting the counter electrode driving signal OED for a half of the surplus period, the "Hi" periods and the "Lo" periods can have the same length during the total vertical period, thereby reducing the low-frequency sound.

Further, the liquid crystal display device 1 may be so arranged that, when the "Hi" period of the counter electrode driving signal OED is longer than the "Lo" period and the polarity is inverted for a half of the surplus period, the polarity may be inverted at any timing during one vertical period.

With this, when one of the "Hi" period and the "Lo" period of the counter electrode driving signal OED is longer than the other, a period of the signal having the longer polarity may be inverted in any number of times at any timing during the vertical period, thereby reducing the low-frequency sound.

As described above, the low-frequency sound can be reduced in principle by inverting the counter electrode generating signal REVC only once. However, since the counter electrode generating signal REVC itself waves, in actuality, it is better to divide the counter electrode generating signal REVC into a larger number of smaller waves during the retrace period so as to further reduce the low-frequency sound. Thus, the REVC signal output circuit 34 may invert the counter electrode generating signal REVC in a plurality of times during one vertical period. The REVC signal output circuit 34 may generate the signal by inverting the signal at any timing as long as the timing to reset the horizontal counter 33 is fixed. For example, other than the counter electrode generating signal REVC, any signal can be used as long as it is necessary for generating a common waveform.

Lastly, a method for driving a liquid crystal display device of the present invention which includes (i) a plurality of signal electrodes, (ii) a plurality of scanning electrodes which cross the plurality of signal electrodes, (iii) an active element provided in a vicinity of each intersection at which one of the plurality of signal electrodes and one of the plurality of scanning electrodes cross and connected to the one of the plurality of signal electrodes and the one of the plurality of scanning electrodes, (iv) a pixel electrode driven by the active element, and (v) a counter electrode to which an AC signal is applied, and which faces the pixel electrode, may be arranged so as to have the step of generating a counter electrode driving signal, which drives the counter electrode, in such a manner that, when a root-mean-square value of voltage in a period of one polarity is different from a root-mean-square value of voltage in a period of the other polarity, the root-mean-square value of voltage in the period of one polarity becomes equal to the root-mean-square value of voltage in the period of the other polarity during one vertical period.

Generally, in the video display period, the counter electrode driving signal is inverted every horizontal period. On the other hand, in the vertical retrace period, the counter electrode driving signal may be inverted at any timing.

With the above-described method, the both polarities ("Hi (+ polarity)" and "Lo (− polarity)") of the counter electrode driving signal have the same root-mean-square value of voltage during one vertical period, thereby reducing the low-frequency sound caused by the piezoelectricity of a liquid crystal capacitance. Further, the timing to invert the polarity of the counter electrode driving signal can be varied while reducing the low-frequency sound. Namely, it is possible to reduce the low-frequency sound caused by the piezoelectricity of a liquid crystal capacitance, even when the interval for inverting the polarity varies.

Therefore, with the above-described method for driving the liquid crystal display device, it is possible to realize a liquid crystal display device that can prevent the low-frequency sound from the panel surface and thus does not disturb quiet surroundings, even when the counter electrode driving signal is inverted every horizontal period, for example, during one vertical period to prevent image burn on the panel. This liquid crystal display device is preferably used as a liquid crystal display device which is, recently in many cases, used in a quiet place such as an office, for example.

Note that, generally, in a liquid crystal display device using a line driving method, a potential difference between the counter electrode and a gradation power supply voltage determines a gradation value to be displayed. Namely, when the counter electrode generating signal is inverted at a timing during the display period in a liquid crystal display device using a line inversion driving method, a problem occurs such that display color turns. Thus, when inverting the counter electrode generating signal REVC as described above, it is easier in terms of circuit design to invert the counter electrode generating signal only during the vertical retrace period where liquid crystal display is not shown. However, by adding a circuit to prevent the problem in liquid crystal display occurs when inverting the counter electrode generating signal during the display period, it becomes possible to invert the counter electrode generating signal at any timing during one vertical period including the display period.

Further, the method for driving the liquid crystal display device of the present invention may be so arranged that the polarity of the counter electrode driving signal is inverted in synchronism with a horizontal synchronizing signal.

With this method, the present invention can be realized more easily because the polarity of the counter electrode driving signal can be inverted in synchronism with the horizontal synchronizing signal.

Further, the method for driving the liquid crystal display device of the present invention may be so arranged that the counter electrode driving signal is generated in such a manner that the polarity is inverted every predetermined period, and, when the number of periods of one polarity is different from the number of periods of the other polarity during one vertical period, the number of periods of one polarity becomes equal to the number of periods of the other polarity.

With this method, the polarity is inverted so that the number of periods of one polarity becomes equal to the number of periods of the other polarity during one vertical period, thereby allowing the "Hi (+ polarity)" periods in total and the "Lo (− polarity)" periods in total to have the same length during one vertical period.

With this, one polarity of the counter electrode driving signal does not longer than the other polarity, thereby reducing the low-frequency sound caused by the piezoelectricity of a liquid crystal capacitance.

Further, the method for driving the liquid crystal display device of the present invention may be so arranged that the counter electrode driving signal is generated in synchronism with a horizontal synchronizing signal in such a manner that the polarity is inverted every horizontal period, and, when one polarity has a length of periods different from the other polarity during one vertical period, the both polarities have a same length of periods by inverting the polarity having the longer period at any timing during one horizontal period.

With this method, the counter electrode driving signal is inverted every horizontal period during one vertical period, thereby preventing image burn on the panel. Further, when one polarity has a longer period than the other polarity during one vertical period, the counter electrode driving signal is generated in such a manner that the polarity having the longer period is inverted at any timing during one horizontal period, thereby allowing the "Hi (+ polarity)" periods in total and the "Lo (− polarity)" periods in total to have the same length during one vertical period. Note that, the polarity having the longer period may be inverted at any timing in any number of times during the vertical period.

With this, one polarity of the counter electrode driving signal does not become longer than the other polarity, thereby reducing the low-frequency sound caused by the piezoelectricity of a liquid crystal capacitance.

Further, the method for driving the liquid crystal display device of the present invention may be so arranged that the counter electrode driving signal is generated in such a manner that the polarity having the longer period during one vertical period is inverted for a half of a surplus period of the longer period.

With this method, when one polarity has a longer period than the other polarity during one vertical period, the counter electrode driving signal is generated in such a manner that the polarity having the longer period is inverted for a half of the surplus period, thereby allowing the "Hi (+ polarity)" periods in total and the "Lo (− polarity)" periods in total to have the same length during one vertical period. Note that, the polarity having the longer period may be inverted for the half of the surplus signal period at any timing in any number of times during the vertical period.

With this, one polarity of the counter electrode driving signal does not become longer than the other polarity, thereby reducing the low-frequency sound caused by the piezoelectricity of a liquid crystal capacitance.

Further, a liquid crystal display device of the present invention may arranged so as to include counter electrode driving signal generating means for generating a counter electrode driving signal using the above-described method for driving the liquid crystal display device.

With this arrangement, one polarity of the counter electrode driving signal does not become longer than the other polarity, thereby reducing the low-frequency sound caused by the piezoelectricity of a liquid crystal capacitance. Therefore, it is possible to realize a liquid crystal display device that can prevent the low-frequency sound from the panel surface and thus does not disturb quiet surroundings. This liquid crystal display device is preferably used as a liquid crystal display device which is, recently in many cases, used in a quiet place such as an office, for example.

Further, the liquid crystal display device may be so arranged to be further provided with counting means for counting horizontal periods during one vertical period; and judging means for judging whether the number of horizontal periods during one vertical period is even or odd, based on the counting means.

With this arrangement, the counting means and the judging means can judge whether the number of horizontal periods during one vertical period is even or odd, thereby generating the counter electrode generating signal in accordance with each case. Namely, even a liquid crystal display device that can vary the number of horizontal periods during one vertical period can automatically judge whether or not one polarity of the counter electrode driving signal has a longer period than the other, based on the judgment result, thereby performing the polarity inversion to adjust the longer period if necessary. This can constantly reduce the low-frequency sound caused by the piezoelectricity of a liquid crystal capacitance, irrespective of the setting of the horizontal and vertical periods.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A method for driving a liquid crystal display device which includes (i) a plurality of signal electrodes, (ii) a plurality of scanning electrodes which cross said plurality of signal electrodes, (iii) an active element provided in a vicinity of each intersection at which one of said plurality of scanning electrodes cross and connected to said one of said plurality of signal electrodes and said one of said plurality of scanning electrodes, (iv) a pixel electrode driven by said active element, and (v) a counter electrode to which an AC signal is applied, and which faces said pixel electrode, said method comprising the step of generating a counter electrode driving signal, which drives said counter electrode, in such a manner that, when a root-mean-square value of voltage in periods of one polarity is different from a root-mean-square value of voltage in periods of the other polarity, the root-mean-square value of voltage in the periods of one polarity becomes equal to the root-mean-square value of voltage in the periods of the other polarity during one vertical period.

2. The method for driving the liquid crystal display device as set forth in claim 1, wherein:

the polarity of said counter electrode driving signal is inverted in synchronism with a horizontal synchronizing signal.

3. The method for driving the liquid crystal display device as set forth in claim 1, wherein:

said counter electrode driving signal is generated in such a manner that the polarity is inverted every predetermined period, and, when the number of periods of one polarity is different from the number of periods of the other polarity during one vertical period, the number of periods of one polarity becomes equal to the number of periods of the other polarity.

4. The method for driving the liquid crystal display device as set forth in claim 2, wherein:

said counter electrode driving signal is generated in such a manner that the polarity is inverted every predetermined period, and, when the number of periods of one polarity is different from the number of periods of the other polarity during one vertical period, the number of periods of one polarity becomes equal to the number of periods of the other polarity.

5. The method for driving the liquid crystal display device as set forth in claim 1, wherein:

said counter electrode driving signal is generated in synchronism with a horizontal synchronizing signal in such a manner that the polarity is inverted every horizontal period, and, when one polarity has a length of periods different from the other polarity during one vertical period, the both polarities have a same length of periods by inverting the polarity having the longer period at any timing during one horizontal period.

6. The method for driving the liquid crystal display device as set forth in claim 2, wherein:

said counter electrode driving signal is generated in synchronism with a horizontal synchronizing signal in such a manner that the polarity is inverted every horizontal period, and, when one polarity has a length of periods different from the other polarity during one vertical period, the both polarities have a same length of periods by inverting the polarity having the longer period at any timing during one horizontal period.

7. The method for driving the liquid crystal display device as set forth in claim 5, wherein:

said counter electrode driving signal is generated in such a manner that the polarity having the longer period during one vertical period is inverted for a half of a surplus period of the longer period.

8. The method for driving the liquid crystal display device as set forth in claim 6, wherein:

said counter electrode driving signal is generated in such a manner that the polarity having the longer period during one vertical period is inverted for a half of a surplus period of the longer period.

9. The method for driving the liquid crystal display device as set forth in claim 1, wherein:

said counter electrode driving signal during a vertical retrace period is adjusted in such a manner that, when a root-mean-square value of voltage in periods of one polarity is different from a root-mean-square value of voltage in periods of the other polarity, the root-mean-square value of voltage in the periods of one polarity becomes equal to the root-mean-square value of voltage in the periods of the other polarity during one vertical period.

10. A liquid crystal display device, comprising:

a plurality of signal electrodes;

a plurality of scanning electrodes which cross said plurality of signal electrodes;

an active element provided in a vicinity of each intersection at which one of said plurality of signal electrodes and one of said plurality of scanning electrodes cross and connected to said one of said plurality of signal electrodes and said one of said plurality of scanning electrodes;

a pixel electrode driven by said active element;

a counter electrode to which an AC signal is applied, and which faces said pixel electrode; and counter electrode driving signal generating means for generating a counter electrode driving signal, which drives said counter electrode, in such a manner that, when a root-mean-square value of voltage in periods of one polarity is different from a root-mean-square value of voltage in periods of the other polarity, the root-mean-square value of voltage in periods of one polarity becomes equal to the root-mean-square value of voltage in the periods of the other polarity during one vertical period.

11. The liquid crystal display device as set forth in claim 10, further comprising:

counting means for counting horizontal periods during one vertical period; and judging means for judging whether the number of horizontal periods during one vertical period is even or odd, based on said counting means.

12. The liquid crystal display device as set forth in claim 10, wherein:

said counter electrode driving signal generating means adjusts said counter electrode driving signal during a vertical retrace period in such a manner that, when a root-mean-square value of voltage in periods of one polarity is different from a root-mean-square value of voltage in periods of the other polarity, the root-mean-square value of voltage in the periods of one polarity becomes equal to the root-mean-square value of voltage in the periods of the other polarity during one vertical period.

13. A method for driving a liquid crystal display device which includes a plurality of signal electrodes, a plurality of scanning electrodes, an active element provided in a vicinity of each signal and scanning electrode intersection, a pixel electrode driven by the active element, and a counter electrode, said method comprising:

generating a signal to drive the counter electrode such that, when a root-mean-square value of voltage in periods of one polarity would be different from a root-mean-square value of voltage in periods of the other polarity, the root-mean-square value of voltage in the periods of one polarity is adjusted to equal to the root-mean-square value of voltage in the periods of the other polarity during one vertical period.

* * * * *